United States Patent [19]

Hanson et al.

[11] 3,982,406

[45] Sept. 28, 1976

[54] REFRIGERATOR WATER STORAGE AND DISPENSING SYSTEM WITH WATER FILTER

[75] Inventors: Robert S. Hanson, Kettering; Louis D. Benasutti, Fairborn, both of Ohio

[73] Assignee: General Motors Corporation, Detroit, Mich.

[22] Filed: Nov. 28, 1975

[21] Appl. No.: 636,211

[52] U.S. Cl. ..... 62/339; 62/396; 222/146 C

[51] Int. Cl.[2] ..... F25D 23/12; B67D 5/62

[58] Field of Search ..... 62/337, 338, 339, 396; 222/146 C; 210/282, DIG. 17

[56] References Cited

UNITED STATES PATENTS

| | | | |
|---|---|---|---|
| 1,557,200 | 10/1925 | Hull | 62/339 |
| 1,692,223 | 11/1928 | Pinkerton et al. | 62/339 |
| 2,089,961 | 8/1937 | Hull | 62/339 |
| 2,623,367 | 12/1952 | Morrison | 62/249 |
| 3,342,340 | 9/1967 | Shindell | 210/282 |
| 3,511,415 | 5/1970 | Crowe | 62/339 |
| 3,788,094 | 1/1974 | Benasutti et al. | 62/339 |
| 3,834,178 | 9/1974 | Pink | 62/338 |
| 3,934,757 | 1/1976 | Malek | 222/146 C |

*Primary Examiner*—Lloyd L. King
*Attorney, Agent, or Firm*—Edward P. Barthel

[57] ABSTRACT

A refrigerator cabinet having a chilled water dispensing service area accessible from the exterior of the cabinet with a vertically extending water supply storage tank and filter cartridge assembly located in the fresh food compartment with the filter cartridge coextensive with one vertical edge of the tank positioning the cartridge upper inlet adaptor integral tube positioned adjacent an upper outlet of the tank. The tank has a serpentine storage volume comprising a plurality of substantially horizontal extending passes connecting the tank inlet and outlet with the tank uppermost pass extending at an inclined axis toward the tank outlet. The adaptor tube axis is inclined downwardly so as to be complementary to the upwardly inclined axis of the tank outlet whereby chilled water from the tank is purged of air and filtered just prior to being dispensed at the service area.

3 Claims, 4 Drawing Figures

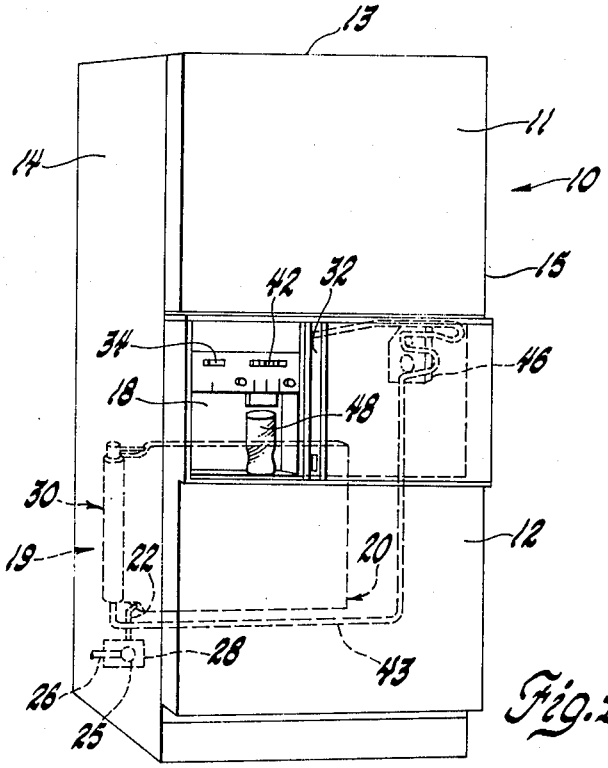
Fig. 1
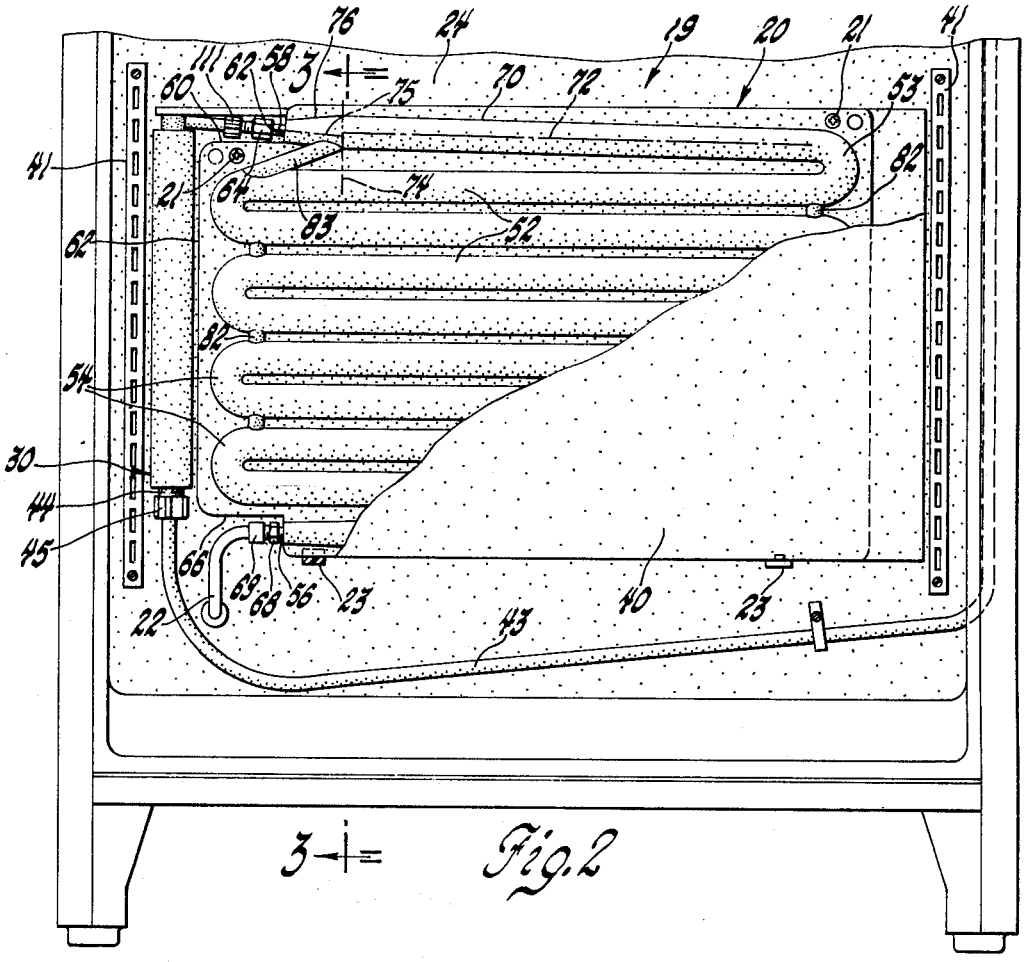
3 Fig. 2

REFRIGERATOR WATER STORAGE AND DISPENSING SYSTEM WITH WATER FILTER

This invention relates to refrigerator cabinet chilled water dispensing systems and is directed to a water storage tank and filter cartridge assembly therefor.

A recent development in the refrigerator cabinet art involves the introduction of domestic refrigerators with water, ice and juice dispensing service areas accessible from the exterior of the cabinet. One such refrigerator is disclosed in co-pending U.S. Patent Application Ser. No. 505,452 to L. D. Benasutti, et al., now pat. no. 3,949,903. The present application is an improved water dispensing system wherein undesirable taste elements such as chemicals and gases are removed from the stored supply of water. The water is filtered by means of an activated carbon filter cartridge placed in the water circuit downstream from the storage tank in the fresh food compartment of the refrigerator, thereby filtering the chilled water just before reaching the service area dispenser to insure that the water supplied from the household system as well as the water being stored in the refrigerator tank is filtered just prior to being dispensed.

It is an object of the present invention to provide a water storage and filtering cartridge assembly for use in the fresh food compartment of a domestic refrigerator having a water dispensing service area accessible from the exterior of the cabinet, wherein the water is filtered just prior to being dispensed from the refrigerator.

It is another object of the present invention to provide a domestic refrigerator for dispensing chilled water from a service area accessible from the exterior of the cabinet by means of a water supply storage tank and filter cartridge assembly in which the storage tank has a serpentine volume comprising a plurality of substantially horizontally extending passes connecting the inlet and outlet of the tank, with the uppermost pass extending at an inclined angle toward the outlet such that the inlet adaptor housing on the uppermost part of the filter cartridge has a downwardly sloped integral tube positioned with its axis in substantially coaxial relation with the outlet of the upwardly sloped axis of the uppermost inclined pass whereby chilled water from the tank is purged of air and filtered just prior to being dispensed at the service area.

These and other objects of the present invention will be apparent from the following description, reference being had to the accompanying drawings wherein a preferred embodiment of the invention is clearly shown. In the Drawings:

FIG. 1 is a perspective view of a refrigerator cabinet incorporating the present invention;

FIG. 2 is a fragmentary front elevational view of a portion of the refrigerator fresh food compartment showing the water storage tank and filter cartridge assembly;

Figure 3:
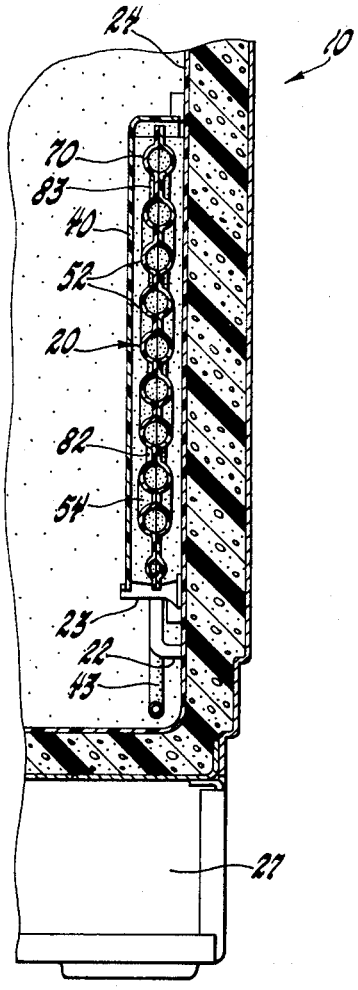
FIG. 3 is a sectional view on line 3—3 of FIG. 2.

Referring now to the drawings, there is shown in FIG. 1 a refrigerator cabinet 10 having an upper freezer compartment closed by an upper door 11 and a lower fresh food compartment closed by a lower door 12, together with insulated top 13 and side walls 14 and 15. The lower fresh food door 12 outer face has a combined ice cube, water and juice dispensing service area 18 provided therein, with the chilled water and juice dispensing portion of the service area shown and described in the abovementioned Benasutti et al patent application Ser. No. 505,452, assigned to the assignee of the instant application.

As seen in FIGS. 1–3, a water cooling reservoir or storage tank and filter cartridge assembly, generally shown in dashed lines at 19, supplies chilled filtered water to the service area 18. The tank 20, formed of two sections of plastic material such as polyethylene, is rectangular in overall outline and is positioned by upper fasteners 21 and lower brackets 23 in a vertical plane on the lower portion of the fresh food compartment liner rear wall 24 with inlet tube 22 connected via a solenoid operated line valve 25 to a conventional household water supply line 26. The control valve 25 is preferably located in the machine compartment 27 or on the rear wall of the cabinet and is actuated in response to the energization of an electric solenoid 28 associated therewith as shown in the Benasutti patent application. The water storage tank 20 includes a filter cartridge 30 providing a storage assembly exposed to above-freezing temperatures within the fresh food compartment so as to be maintained in a chilled condition at a temperature range of about 36° to 38° F. As seen in FIG. 1, the service area 18 may be closed by a sliding door partially indicated at 32 so as to conceal the ice cube actuator 34 and beverage dispenser assembly 42. As seen in FIGS. 2 and 3 the assembly 19 is enclosed by a cover member 40 which extends between the shelf supporting stringers 41 with the cover supported at its lower edge by brackets 23.

As seen in FIG. 2 of the preferred form, a length of tubing or flexible plastic water line 43 is connected to outlet 44 (FIG. 4) of the filter cartridge 30 by ferrule nut 45 to the manually actuated water and beverage concentrate dispenser assembly 42 positioned in the door 12, the dispensing spout of which extends into the service area 18 for filling a suitable vessel such as glass 48. Suitable means are provided to allow for the extension or retraction of the flexible water line 43 into and out of the door 12 such as the receptacle 46 (FIG. 1). An example of one such an arrangement is found in U.S. Pat. No. 3,788,094 to L. D. Benasutti et al. With reference to FIG. 2, the water tank and filter cartridge assembly 19 are designed to eliminate any entrapped air by venting same through the dispenser outlet (not shown), while insuring the adequate cooling of the water by providing a serpentine flow thereof through the cooler before it reaches the dispenser. The dispenser 42, as explained in the mentioned Benasutti patent application, uses a jet pump aspirator nozzle which requires a minimum water pressure of about 20 psi gauge supplied to the solenoid valve 25 to insure adequate suction to draw juice concentrate from their storage containers into the jet mixing area of the dispenser for dilution by the water flowing through the jet pump nozzle before being dispensed to a container such as glass 48 in the service area.

The water storage tank 20, shown in detail in FIGS. 2 and 3 of the drawing, includes a plurality of horizontally extending passes or coils 52, series connected by right hand end loops or U-shaped return bends 53 and left hand return bends 54 in staggered relation to form a series flow passageway of serpentine configuration between the water storage tank inlet 56 and the outlet 58. As seen in the vertical sectional view of FIG. 3, the area of the coils 52 provide sufficient volume to define a total water storage capacity of about 3 quarts within the tank. In the disclosed form the inner diameter of the tubular passes 52 is approximately 1 inch while the tank inlet 56 and outlet 58 have a reduced diameter of about 0.40 in. close to the diammeter of the supply line 22 conveying water from the solenoid valve to the tank.

Figure 4:
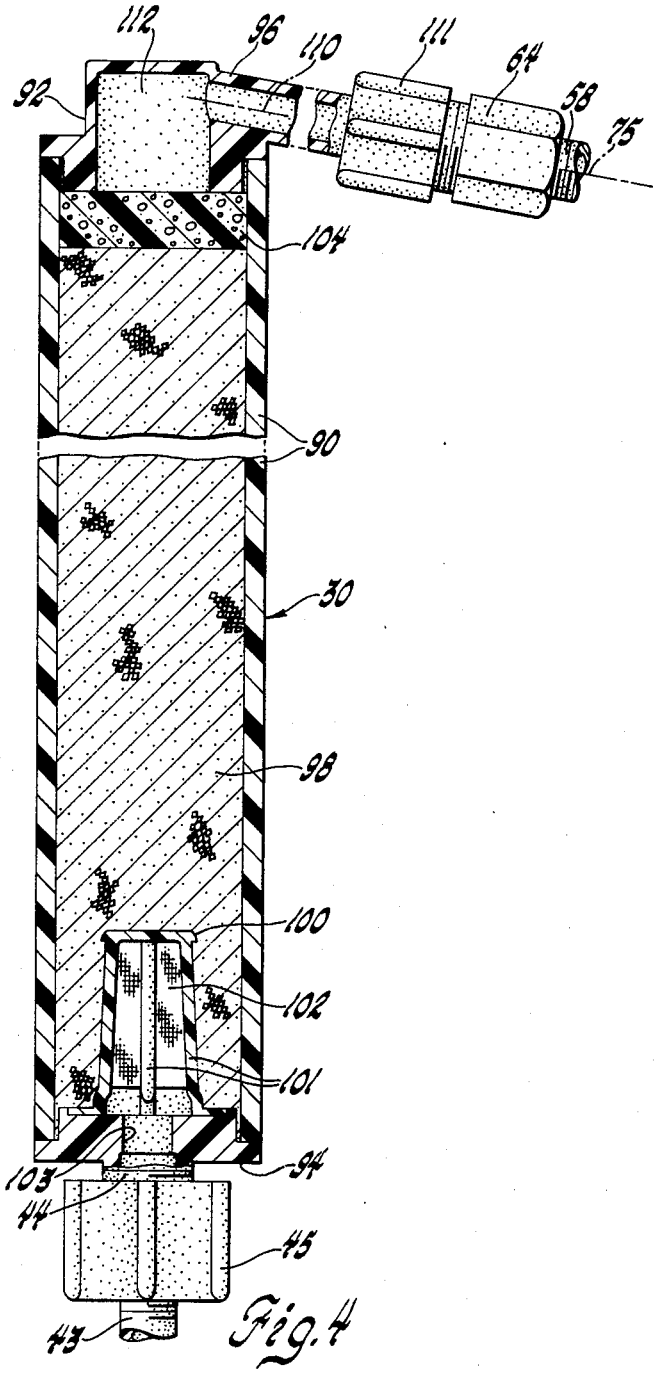
FIG. 4 is a vertical sectional view of the filter.

As seen in FIG. 2, the tank outlet 58 is located in a notched-out upper corner 60 of the supply tank adjacent one vertical edge which in the disclosed form is the left hand vertical edge 62 of the tank. FIG. 4 shows outlet 58 threaded to receive a connector member 64 with the outlet 58 terminating at a location recessed inwardly a predetermined distance from the adjacent vertical edge 62 of the tank. The tank inlet 56 is located in the lower portion thereof which, in the preferred embodiment, is the lower notched-out corner 66 formed in the adjacent lower corner of the tank. The inlet 56 is threaded to receive connector 68 and ferrule nut 69.

FIG. 2 shows the uppermost tank pass 70 extending at a first upwardly inclined or slanted axis 72 toward the outlet 58, which inclination in the preferred embodiment is of the order of about 3 degrees from the horizontal. The axis 72 ends at a point located on the vertical construction line 74 defining the end of the uppermost pass 70 which pass terminates in a necked-down portion 76 leading to the outlet 58. The outlet 58 is shown sloped on a second axis 75 (FIG. 4) having an upwardly inclined slope equal to or greater than the axis 72 of the uppermost pass 70 and which is shown in the preferred embodiment inclined at an angle of about 10° to the horizontal. It will be noted in FIG. 2 that at the end of each of the horizontal passes 52, adjacent the outlet of each of the U-shaped return bends 53 and 54, a vertically extending integral tube 82 is provided joining the outlet of each return bend to the inlet of the next upwardly staggered return bend. An enlarged integral tank line 83 is sloped inwardly to form a junction between the necked down portion 76 and the outlet of the uppermost U-shaped bend. The connector tubes 82 provide air passage means for any air being purged upwardly within the storage tank and also provide an upward crossover flow passage of the water in the serpentine passes 52 allowing the water an alternate flow passage to short cut one or more of the horizontally disposed passes in the event that a temporary freeze-up condition exists in a portion of the tank, thus preventing bulging or possible cracking of the supply tank.

Turning now to FIG. 4, the filter cartridge 30 is shown consisting of an elongated hollow cylindrical casing or tube 90, positioned in vertically juxtaposed relation between the tank edge 62 and left hand shelf stringer 41, having an upper inlet adaptor portion 92 and the lower outlet adaptor portion 94 integral with oultet 44. In the disclosed form the water filter cartridge cylindrical casing is formed of plastic material and has a substantially larger inner diameter, about 1.25 inches in the disclosed form, than its inlet tube 96 which is molded integrally with the adaptor 92. The filter cartridge upper and lower adaptors 92 and 94 are of plastic and suitable secured on each end of the plastic tube 90 as by spin welding so as to withstand an internal water pressure of the order of 60 pounds per square inch gauge without leaking. The filter container has an overall height of approximately 13.0 inches enabling the cartridge to be filled with approximately 3.5 ounces of suitable filter material 98 for filtering out odor and taste from water, which material in the preferred form consists of activated granular charcoal having a packing density of about 0.43 grams per cubic centimeter and a mesh size of 8/10 (Tyler).

The lower adaptor 94 has a cup-shaped member 100 having four vertical spacers 101 defining four openings covered by mesh filtering screen 102 on the upstream side of outlet passage 103 such that the granular material 98 is confined between a circular resilient upper sponge rubber pad 104 positioned between the granular material and the upper adaptor 92 while the cup-shaped member 100 extends upwardly into the material 98 to enclose the adaptor outlet passage 103. Thus, mesh filtering screen 102 retains the granular material and any foreign objects in the cartridge but permits the ready flow of water therethrough into passage 103 of the cartridge lower outlet 44. The casing 90 inner diameter together with the mesh size of the granular filter charcoal to insure a minimal pressure drop between the household water supply at the solenoid valve 25 and the outlet of the supply conduit 43 delivered to the inlet of dispenser 42. As an example it has been determined that applicant's inventive filtering arrangement insures that a household water supply as low as about 20 pounds of gauge pressure (20 psig) will be adequate to operate an aspirating juice dispenser such as that disclosed in the mentioned Benasutti patent application.

As seen in FIG. 4, the filter cartridge upper adaptor 92 integral inlet stem or tube 96 extends therefrom on a downwardly inclined axis shown at 110 which is complementary or colinear with the second upwardly inclined axis 75 of the tank outlet 58, allowing single coupling means in the form of connector 64 and ferrule nut 111 to be used to secure the cartridge adaptor inlet tube 96 with the outlet 58 of the tank. In the disclosed form the connector 64 and nut 11 are made of Nylon material such as supplied by the JACO Manufacturing Co.

Another feature of applicants' invention of a unitary sloped cartridge inlet tube 96 results in the upper adaptor 92 inlet chamber housing 112 being located at the highest elevation of any point within the water storage tank 20 and cartridge 30 assembly 19. This assures that any trapped air in the tank serpentine coil 62 is purged or liberated by being driven out of the tank and into the filter cartridge housing 112 for subsequent movement out the supply tube 43 communicating with an aspirating dispenser in the service area.

Yet another feature of applicants' unitary rigid inlet tube 96 is that it allows the filter cartridge 30 to be detachably mounted or supported on the tank 20 solely by means of the single coupling means 64 and 111. By unthreading the nut 111, the in-line cartridge 30 may be disengaged from the tank and unthreading ferrule nut 45 allows the cartridge to be removed from flexible line 43. Thus, when the water conditioning granular activated carbon material 98 of the original cartridge has lost its effectiveness a new cartridge 30 may be easily substituted therefor. It will be appreciated, however, that by locating the filter cartridge within the fresh food compartment so as to maintain it at a reduced temperature of about 36° F. the effective life of the charcoal material is lengthened so that its need for replacement is minimized.

While the embodiment of the present invention constitutes a preferred form, it is to be understood that other forms might be adopted.

We claim:

1. In combination with a domestic refrigerator for dispensing chilled water; a refrigerator insulated cabinet having a chilled water dispensing service area accessible from the exterior of said cabinet, a cold water supply water storage tank in the fresh food storage compartment of said refrigerator having a notched upper corner adjacent one vertical edge of said tank, said tank having a lower inlet and an outlet in said notched upper corner, said tank having a serpetine storage volume comprising a plurality of substantially horizontally extending passes connecting said inlet and said outlet, the uppermost pass extending at a first upwardly inclined axis toward said outlet for purging air from said passes to said outlet, said outlet inclined at a second upwardly inclined axis equal to or greater than said first axis, said outlet terminating at a location recessed inwardly from said one vertical edge of said tank, wherein the improvement comprises an elongated hollow filter cartridge positioned in vertically juxtaposed relation to said one tank edge having an upper inlet adaptor and a lower outlet adaptor, granular water conditioner in said cartridge, said inlet adaptor including a housing forming an upper chamber having an integral tube extending therefrom at a downwardly inclined axis complementary with the said second upwardly inclined axis, fastening means for sealingly connecting said tank outlet and said integral tube to form an assembly of said water storage tank and said cartridge, whereby said filter cartridge upper chamber is at the highest elevation of the water storage tank and cartridge assembly, and conduit means connecting said lower outlet adaptor with water dispenser means in the service area, whereby chilled water from said tank is purged of air and filtered just prior to being dispensed at the service area.

2. In combination with a domestic refrigerator for dispensing chilled water; a refrigerator insulated cabinet having a chilled water dispensing service area accessible from the exterior of said cabinet, a cold water supply water storage tank secured to the rear wall of the fresh food storage compartment of said refrigerator having a notched upper corner adjacent one vertical edge of said tank and a notched lower corner subjacent said notched upper corner, said tank having a lower inlet in said notched lower corner and an outlet in said notched upper corner, said tank having a serpentine storage volume comprising a plurality of substantially horizontally extending passes connecting said inlet and said outlet, the uppermost pass extending at a first upwardly inclined axis toward said outlet for purging air from said passes to said outlet, said outlet inclined at a second upwardly inclined axis equal to or greater than said first axis, said outlet terminating at a location recessed inwardly from said one vertical edge of said tank, wherein the improvement comprises an elongated removable hollow cylindrical filter cartridge positioned in vertically juxtaposed relation to said one tank edge having an upper inlet adaptor and a lower outlet adaptor, a granular water conditioner in said cartridge, said inlet adaptor including a housing forming an upper chamber having an integral rigid tube extending therefrom at a downwardly inclined axis complementary with the said second upwardly inclined axis, a coupling for sealingly and detachably connecting said tank outlet and said cartridge integral tube holding said cartridge on said water storage tank, whereby said filter cartridge upper chamber is at the highest elevation of the water storage tank and cartridge assembly, and a flexible conduit connecting said lower outlet adaptor with water dispenser means in the service area, whereby chilled water from said tank is purged of air and filtered just prior to being dispensed at the service area.

3. In combination with a domestic refrigerator for dispensing chilled water; a refrigerator insulated cabinet having a chilled water dispensing service area accessible from the exterior of said cabinet, a cold water supply water storage tank secured to the rear wall of the fresh food storage compartment of said refrigerator having a notched upper corner adjacent one vertical edge of said tank and a notched lower corner subjacent said notched upper corner, said tank having a lower inlet in said notched lower corner and an outlet in said notched upper corner, said tank having a serpentine storage volume comprising a plurality of substantially horizontally extending passes connecting said inlet and said outlet, the uppermost pass extending at a first upwardly inclined axis of the order of 3° toward said outlet for purging air from said passes to said outlet, said outlet inclined at a second upwardly inclined axis of the order of 10°, said outlet terminating at a location recessed inwardly from said one vertical edge of said tank, wherein the improvement comprises an elongated removable hollow cylindrical filter cartridge positioned in vertically juxtaposed relation to said one tank edge having an upper inlet adaptor and a lower outlet adaptor, a granular charcoal water conditioner in said cartridge, said inlet adaptor of plastic material including a housing forming an upper chamber having an integrally molded rigid tube extending therefrom at a downwardly inclined axis of about 10° so as to be complementary with the said second upwardly inclined axis, a coupling for sealingly and detachably connecting said tank outlet and said cartridge integral tube holding said cartridge on said water storage tank, whereby said filter cartridge upper chamber is at the highest elevation of the water storage tank and cartridge assembly, and a flexible conduit removably connected to said lower outlet adaptor with water dispenser means in the service area, whereby chilled water from said tank is purged of air and filtered just prior to being dispensed at the service area.

* * * * *